US006035582A

United States Patent [19]

Pacific

[11] Patent Number: 6,035,582

[45] Date of Patent: Mar. 14, 2000

[54] FLASHING

[76] Inventor: William L. Pacific, 1 Monroe St., Wakefield, Mass. 01880

[21] Appl. No.: 09/042,920

[22] Filed: Mar. 17, 1998

Related U.S. Application Data

[63] Continuation of application No. 08/527,035, Sep. 12, 1995, abandoned.

[51] Int. Cl.[7] ..... E04D 13/14

[52] U.S. Cl. ..... 52/58; 428/189; 428/906

[58] Field of Search ..... 52/58; 428/189, 428/906

[56] References Cited

U.S. PATENT DOCUMENTS

| | | | |
|---|---|---|---|
| 720,811 | 2/1903 | Ingram | 52/58 |
| 1,700,619 | 1/1929 | Young | 52/62 |
| 2,499,908 | 3/1950 | Figge | 154/117 |
| 2,551,591 | 5/1951 | Foord | 154/129 |
| 2,695,854 | 11/1954 | Mullen | 154/51 |
| 2,721,819 | 10/1955 | Munro | 154/51 |
| 2,734,010 | 2/1956 | Mullen | 154/51 |
| 2,935,865 | 5/1960 | Munro | 154/51 |
| 3,075,868 | 1/1963 | Long | 156/82 |
| 3,093,934 | 6/1963 | Underhill | 52/309.8 X |
| 3,300,913 | 1/1967 | Patry et al. | 52/58 |
| 3,410,037 | 11/1968 | Empson et al. | 52/58 |
| 3,455,076 | 7/1969 | Clarvoe | 52/302.1 |
| 3,496,058 | 2/1970 | Schroter et al. | 161/119 |
| 3,807,103 | 4/1974 | Kantz et al. | 52/58 |
| 3,813,315 | 5/1974 | Valyi | 156/254 |
| 4,248,926 | 2/1981 | Tajima et al. | 52/58 X |
| 4,700,512 | 10/1987 | Laska | 52/58 |
| 5,300,361 | 4/1994 | Vowinkel et al. | 428/304.4 |
| 5,309,685 | 5/1994 | Rathgeber | 52/58 |
| 5,329,741 | 7/1994 | Nicholaidis | 52/309.8 X |
| 5,426,898 | 6/1995 | Larsen | 52/58 |
| 5,469,671 | 11/1995 | Rathgeber et al. | 52/58 |
| 5,711,116 | 1/1998 | Hasan | 52/58 |

OTHER PUBLICATIONS

Reliable Building Products Brochure entitled, "Thru–wall Flashing Architectural Catalog", undated, No. 07650/RBP.

*Primary Examiner*—Beth Aubrey
*Attorney, Agent, or Firm*—Pandiscio & Pandiscio

[57] ABSTRACT

Flashing for rendering a seam in a structure water-tight, wherein the flashing comprises a composite comprising a sheet layer and a foam layer, with the sheet layer comprising a closed surface, waterproof material which is lightweight and flexible, and the foam layer comprising a thermally-insulating material which is lightweight and flexible, and resilient and water-resistant.

19 Claims, 13 Drawing Sheets

Masonry Wall

FLASHING

This is a continuation of U.S. patent application Ser. No. 08/527,035, filed Sep. 12, 1995 by William L. Pacific for FLASHING, now abandoned.

FIELD OF THE INVENTION

This invention relates to the construction industry in general, and more particularly to flashing of the sort used to provide a watertight barrier in structures.

BACKGROUND OF THE INVENTION

It is customary in the construction industry to use flashing to seal the many joints and seams in a structure so as to prevent water from entering the structure.

In the prior art, such flashing typically comprises a copper sheet which is backed with asphalt or fabric or paper. The backing provides a surface to which a mastic can adhere. However, such a construction presents a problem, since the asphalt or fabric or paper can burn in the event of a fire. In addition, depending on the nature of the backing, the fumes given off in such a fire may be carcinogenic. Furthermore, such prior art flashing does not provide a good thermal barrier, and it is not self-sealing. Also, prior art asphalt-backed flashing is relatively heavy, as well as relatively stiff and rigid. This can make it very inconvenient to work with. Furthermore, such flashing becomes even more stiff and rigid in cold weather, making it impossible to form to tight places. In addition, prior art flashing is frequently susceptible to mildew and rotting problems. Also, prior art flashing does not provide a good acoustical barrier.

OBJECTS OF THE INVENTION

Accordingly, one object of the present invention is to provide a new and improved form of flashing.

Another object of the present invention is to provide a new and improved form of flashing which does not utilize a backing made out of asphalt or fabric or paper.

And another object of the present invention is to provide a new and improved form of flashing which is fire-retardant.

Still another object of the present invention is to provide a new and improved form of flashing which provides a good thermal barrier.

Yet another object of the present invention is to provide a new and improved form of flashing which is self-sealing.

And another object of the present invention is to provide a new and improved form of flashing which is relatively lightweight and is flexible under substantially all weather conditions.

Another object of the present invention is to provide a new and improved form of flashing which is less susceptible to mildew and rotting problems.

And another object of the present invention is to provide a new and improved form of flashing which provides a good acoustical barrier.

And still another object of the present invention is to provide an improved method for sealing joints and seams in structures.

SUMMARY OF THE INVENTION

These and other objects of the present invention are addressed by the provision and use of a new and improved form of flashing, wherein the flashing comprises a composite formed out of two layers, a sheet layer and a foam layer.

The sheet layer comprises the water-tight barrier portion of the flashing. The sheet layer is formed out of a closed surface, waterproof material which is also lightweight and flexible. The material used to form the sheet layer is preferably also rustproof, mildew-proof, rot-proof and fireproof, or at least fire-retardant.

The sheet layer is preferably formed out of a thin sheet of copper, aluminum or some other satisfactory metal, or a thin sheet of polyethylene plastic film, polypropylene plastic film, styrene plastic film, or some other satisfactory plastic film.

The foam layer comprises the thermal barrier portion of the flashing. The foam layer is formed out of an insulating material which is also lightweight and flexible. The material used to form the foam layer is also rustproof, mildew-proof, and fireproof, or at least fire-retardant. Significantly, the material used to form the foam layer is both resilient and waterproof, or at least water-resistant, whereby the foam layer can form a watertight seal about any fastening devices which may pierce the flashing during deployment of the flashing. The material used to form the foam layer is also resilient and flexible, whereby the foam layer can fill out any surface imperfections it may lie against. The material used to form the foam layer is also a good acoustical insulator.

The foam layer is preferably formed out of a suitable closed-cell plastic foam, such as a suitable cross-linked or extruded polyethylene foam; or a suitable cross-linked or extruded polypropylene foam; or a suitable extruded polyvinylchloride foam.

The sheet layer and the foam layer are attached to one another so as to form a single composite structure. When the sheet layer and the foam layer are attached together in this way, the sheet layer will tend to give the overall composite structure an adequate degreee of structural integrity, even in those cases where the foam layer tends to be rather soft. If desired, more than one sheet layer, and/or more than one foam layer, may be provided in the flashing.

The flashing of the present invention is used in substantially the same manner as conventional flashing.

Also, if desired, a pressure sensitive adhesive may be positioned on the outside surface of the foam layer so as to faciliate attachment of the flashing to a structure during deployment of the flashing. In this case, the use of mastic may be eliminated during flashing deployment.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts and further wherein.

DETAILED DESCRIPTION OF THE PREFERRED EMBODIMENTS

Figure 1:
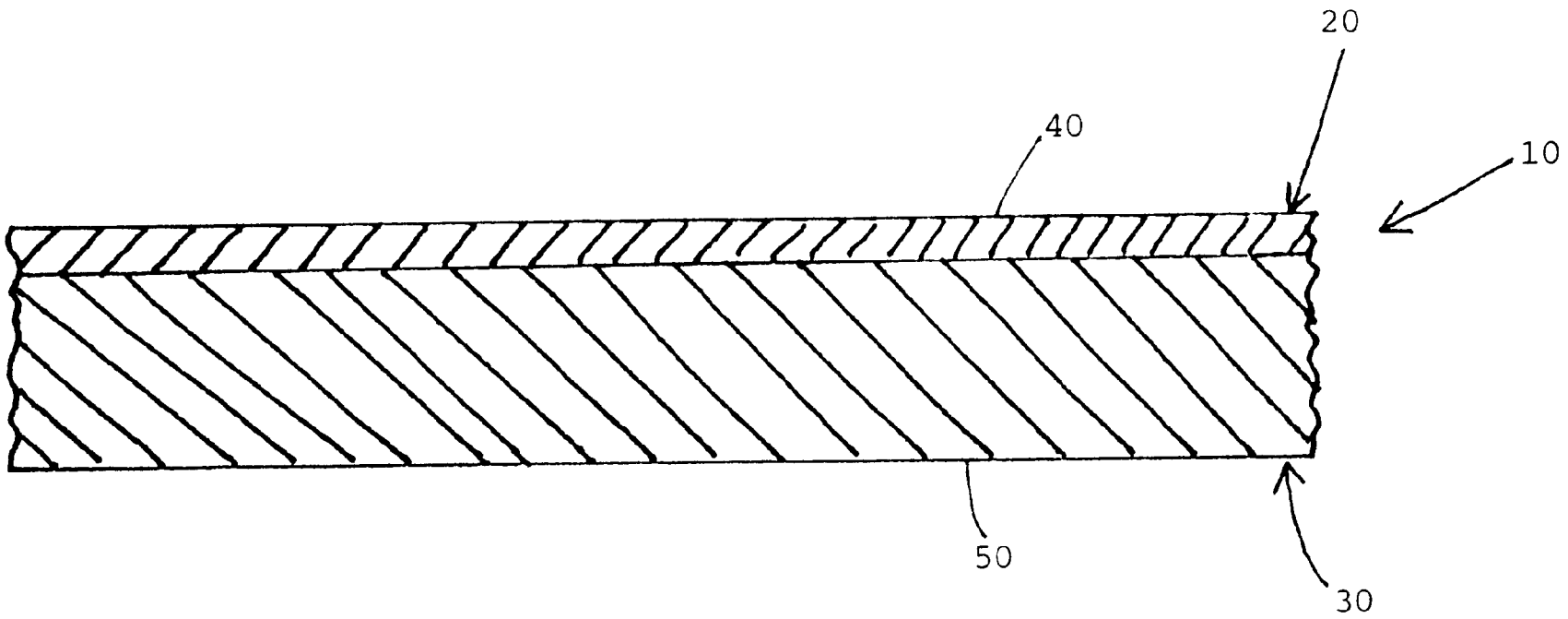
FIG. 1 is a side view, in section, of flashing formed in accordance with the present invention.

Looking first at FIG. 1, there is shown a new and improved form of flashing 10. Flashing 10 comprises a composite formed out of two layers, a sheet layer 20 and a foam layer 30.

Sheet layer 20 constitutes the water-tight barrier portion of the flashing. To this end, sheet layer 20 is formed out of a closed surface, waterproof material which is also lightweight and flexible. The material used to form sheet layer 20 is preferably also rustproof, mildew-proof, rot-proof, and fireproof, or at least fire-retardant. In addition to the foregoing, the material used to form sheet layer 20 is capable of being secured to foam layer 30.

Sheet layer 20 is preferably formed out of a thin sheet of copper, aluminum or some other satisfactory metal, or a thin sheet of polyethylene plastic film, polypropylene plastic film, styrene plastic film, or some other satisfactory plastic film. Where sheet layer 20 comprises plastic film, it is preferred that the film be UV resistant. The thickness of sheet layer 20 can vary according to its particular composition and the application at hand, so long as it remains water-impervious, lightweight and flexible. Preferably sheet layer 20 has a thickness of between approximately 0.001 inch and approximately 0.125 inch.

Foam layer 30 constitutes the thermal barrier portion of the flashing. To this end, foam layer 30 is formed out of an insulating material which is also lightweight and flexible. The material used to form foam layer 30 is also rustproof, mildew-proof, rot-proof and fireproof, or at least fire-retardant. Significantly, the material used to form foam layer 30 is both resilient and waterproof, or at least water resistant, whereby foam layer 30 can form a waterproof seal about any fastening devices which may pierce the flashing during deployment of the flashing, as will hereinafter be disclosed in further detail. In addition, it is important that the material used to form foam layer 30 be resilient and flexible, whereby foam layer 30 can fill out any surface imperfections it may lie against, as will hereinafter also be disclosed in further detail. Furthermore, it is important that the material used to form foam layer 30 be capable of providing a good acoustical barrier. In addition, the material used to form sheet layer 30 is capable of being secured to both sheet layer 20 on the one hand, and to a masonry mastic on the other hand.

Foam layer 30 is preferably formed out of a suitable closed-cell plastic foam. For example, it can be formed out of a suitable cross-linked or extruded polyethylene foam; or it can be formed out of a suitable cross-linked or extruded polypropylene foam; or it can be formed out of a suitable extruded polyvinylchoride foam; or it can be formed out of some other suitable foam. However, foam layer 30 should not be formed out of a polyurethane foam, since closed-cell polyurethane foams are too rigid for the application at hand, while open-cell polyurethane foams are not capable of providing the desired sealing functions. Preferably foam layer 30 has a density of approximately 0.5 $lb/ft^3$ to approximately 9.0 $lbs/ft^3$.

The thickness of foam layer 30 can vary according to its particular composition and the application at hand, so long as it provides a good thermal and acoustical barrier, is lightweight and flexible, and can provide the desired sealing functions. Preferably foam layer 30 has a thickness of between approximately 0.015 inch and approximately 0.250 inch.

Figure 2:
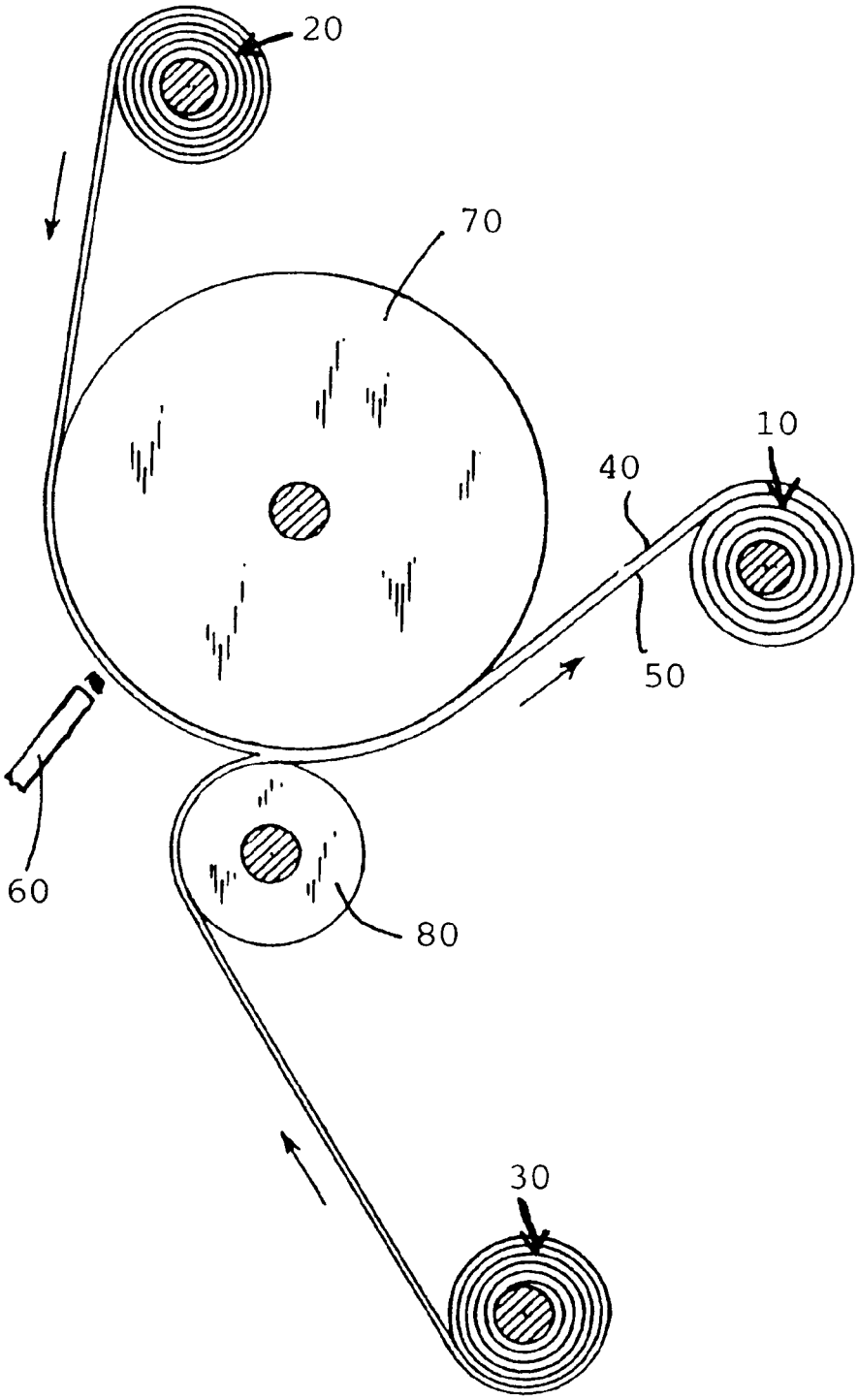
FIG. 2 is a schematic representation showing the flashing's sheet layer and foam layer being flame bonded together so as to form a single composite structure.

Sheet layer 20 and foam layer 30 are attached to one another so as to form a single composite structure having a first, or"outer", surface 40 and a second, or "inner", surface 50. Sheet layer 20 and foam layer 30 may be attached together using a conventional spray or heat-melt adhesive or, more preferably, sheet layer 20 and foam layer 30 are bonded together through flame lamination. More particularly, and looking now at FIG. 2, there is shown conventional flame apparatus 60 and roller apparatus 70, 80 for flame bonding sheet layer 20 and foam layer 30 together. Regardless of the particular manner of attachment, sheet layer 20 and foam layer 30 are securely attached to one another so that they thereafter function as a single composite structure. Preferably, sheet layer 20 and foam layer 30 are attached to one another so as to form a so-called"foam tearing bond", i.e., so that the material of foam layer 30 will tear before the bond releases. When sheet layer 20 and foam layer 30 are attached together in this way, sheet layer 20 will tend to give flashing 10 an adequate degree of structural integrity, even in those cases where foam layer 30 tends to be rather soft.

Figure 3:
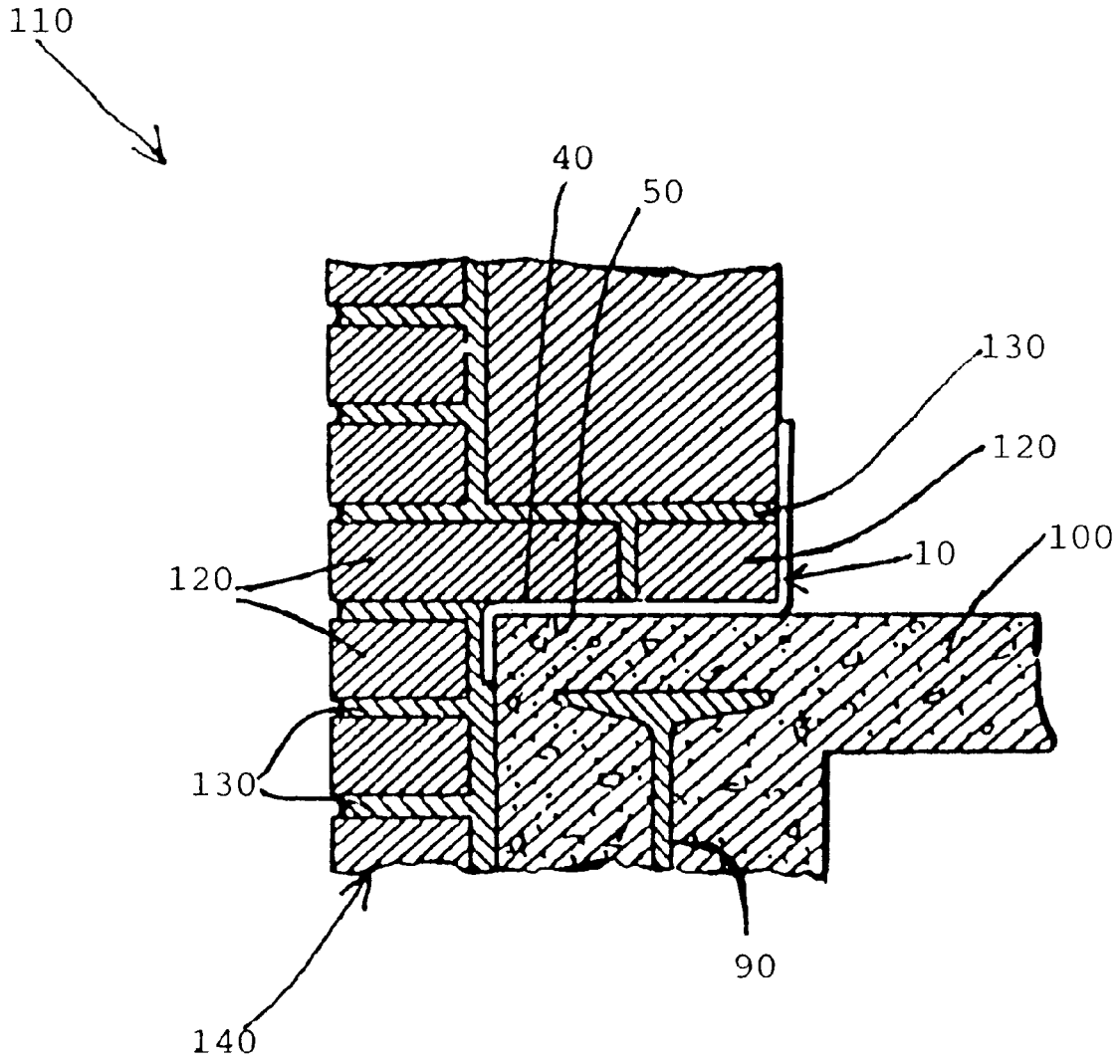
FIG. 3 is a side view, in section, of the flashing of FIG. 1 deployed within a masonry structure.

Flashing 10 can be used in ways well known in the art to seal joints and seams in structures. By way of example, FIG. 3 shows a typical construction application which might employ flashing 10. More particularly, FIG. 3 shows a spandrel beam 90 supporting the concrete flooring 100 of a masonry building 110, with bricks 120 and mortar 130 forming the outer wall 140 of the building. In this example, flashing 10 is laid between concrete flooring 100 and the courses of brick 120, embedded in the mortar 130. Flashing 10 is laid so that its outer surface 40 faces the exterior of the building (i.e., bricks 120), and so that its inner surface 50 faces the interior of the building (i.e., concrete flooring 100). Preferably mastic is applied to the flashing's inner surface 50 so as to cause it to adhere to concrete flooring 100. The mastic is preferably an asbestos-free mastic.

Figure 4:
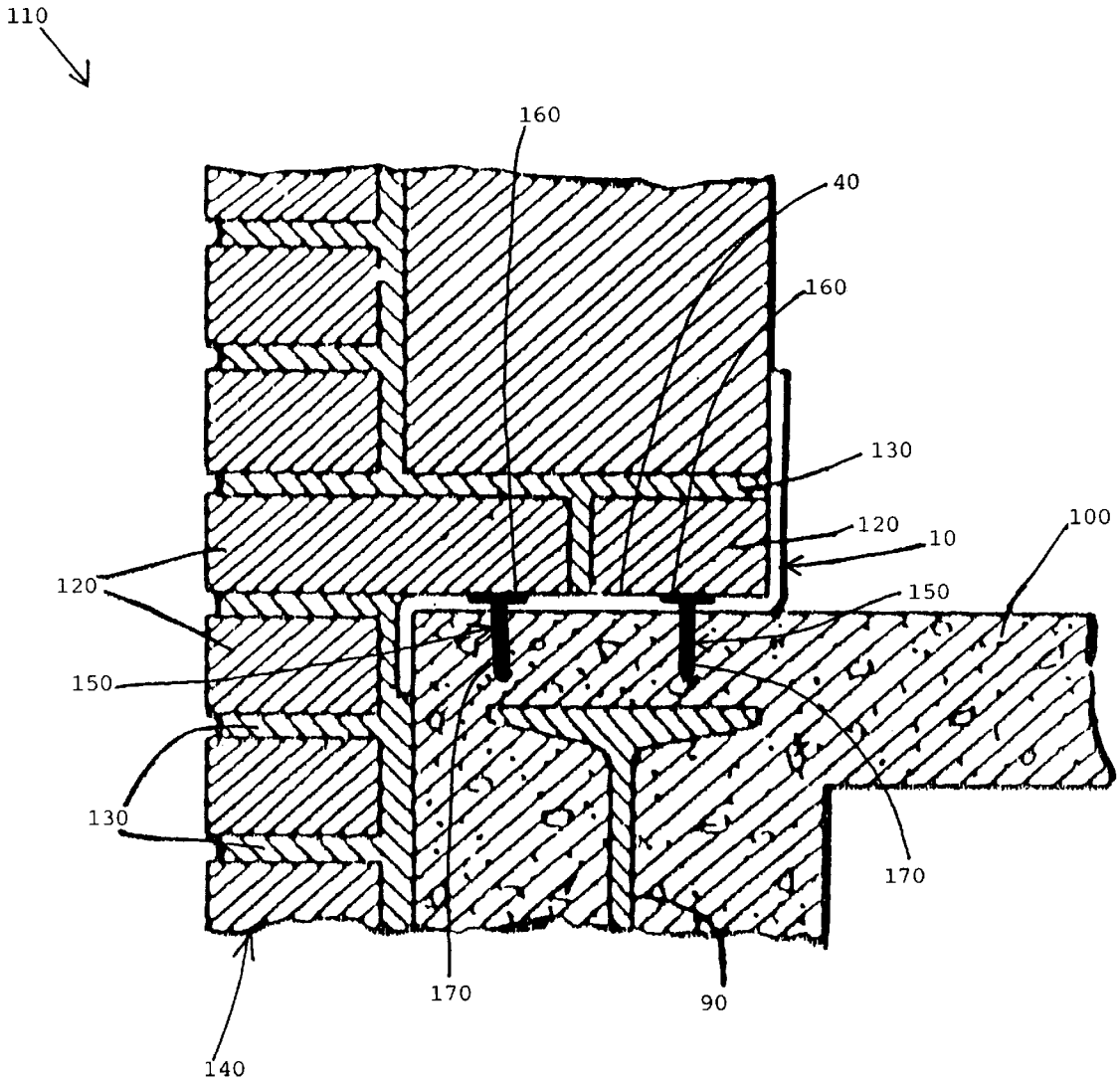
FIG. 4 is an enlarged view similar to that of FIG. 3, except that fastening pins are shown attaching the flashing to the masonry structure.

It is an important aspect of the present invention that foam layer 30 be capable of forming a waterproof seal about any fastening devices which might pierce the flashing during deployment of the flashing. Thus, for example, FIG. 4 shows fastening pins 150 attaching flashing 10 to concrete flooring 100. In such a situation, the heads 160 of pins 150 would bear against the flashing's outer surface 40, while the shanks 170 of pins 150 would pass through the thickness of the flashing and into concrete flooring 100. In this case, the resilient, flexible nature of the flashing's foam layer 30 will permit the foam layer to seal around the shanks of the fastening pins so as to prohibit water from passing through the flashing alongside the fastening pins.

Figure 5:
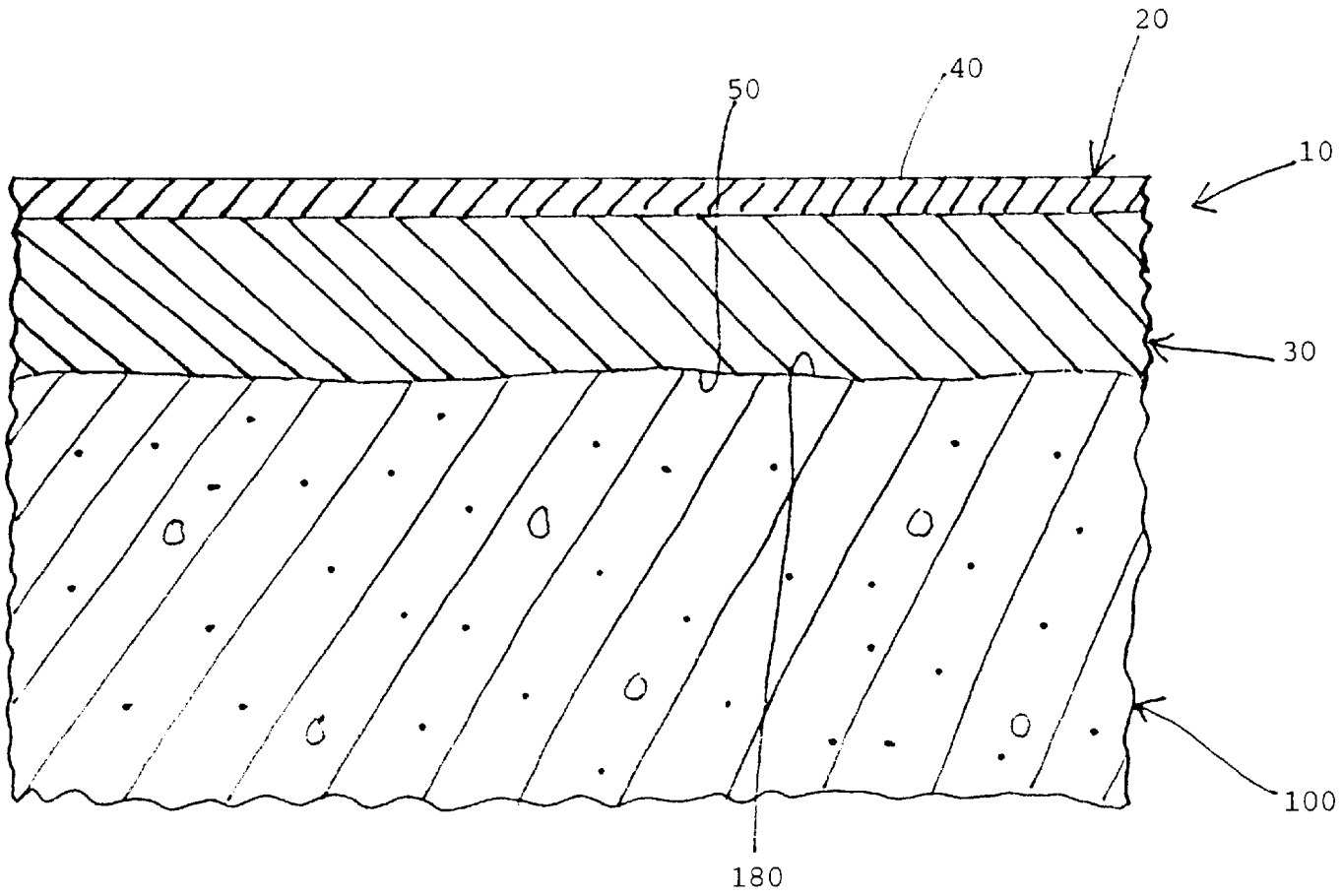
FIG. 5 is an enlarged view similar to that of FIG. 3, except that the inner surface of the flashing is shown contouring itself against the somewhat irregular top surface of concrete flooring.

It is an additional important aspect of the present invention that foam layer 30 be capable of filling any surface imperfections it may lie against. Thus, for example, FIG. 5 shows flashing 10 lying against the somewhat irregular top surface 180 of concrete flooring 100. In this case, the resilient, flexible nature of the flashing's foam layer 30 will permit the flashing's inner surface 50 to contour itself against the somewhat irregular top surface of concrete flooring 100.

Modifications of the Preferred Embodiments

Various modifications may be made to the structures and uses described above without departing from the scope of the present invention.

Thus, for example, it is possible to use more than a single sheet layer 20 and/or more than a single foam layer 30 so as to form flashing in accordance with the present invention.

Figure 6:
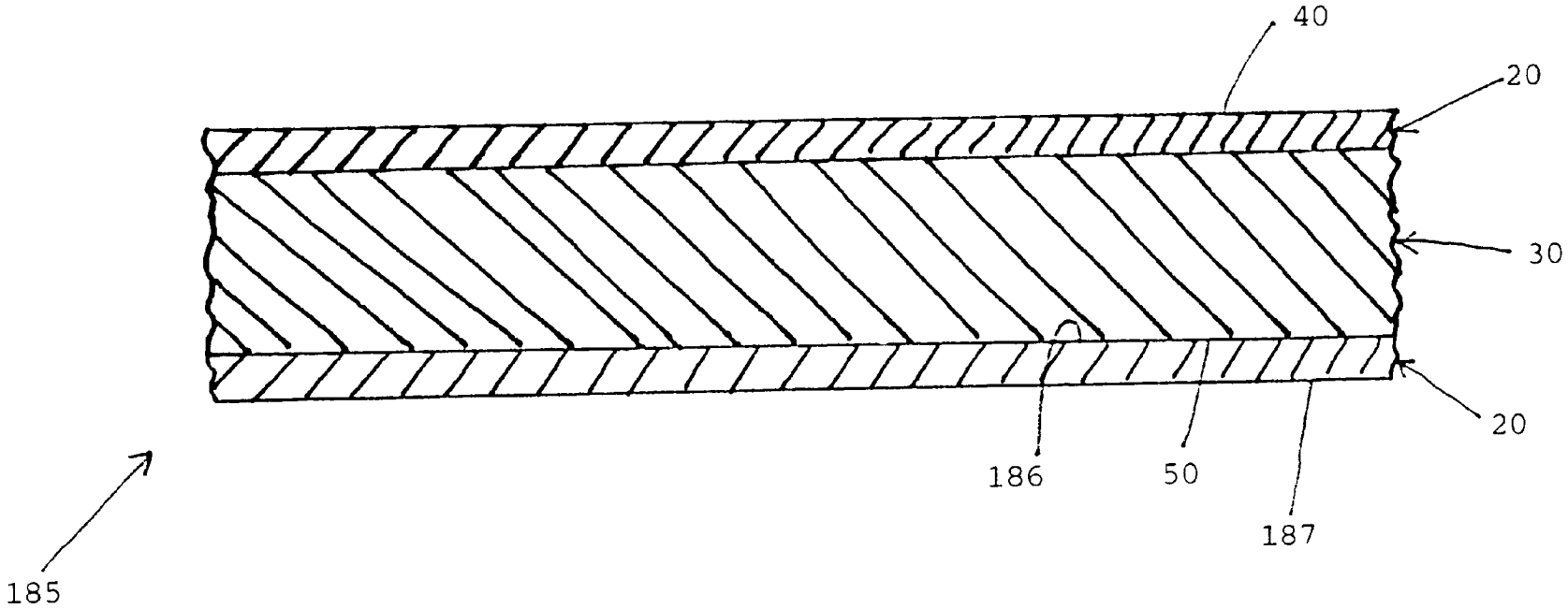
FIG. 6 is a side view, in section, of an alternative embodiment of the present invention.

By way of example, FIG. 6 shows a flashing 185 comprising two sheet layers 20 and one foam layer 30, wherein one sheet layer 20 is disposed on each side of foam layer 30, and wherein the various layers are all bonded together into a single composite structure. With this construction, the inner surface 50 of foam layer 30 will lie against the outer surface 186 of one of the sheet layers; hence, the inner surface 187 of that same sheet layer will constitute the inner surface of the flashing composite.

Figure 7:
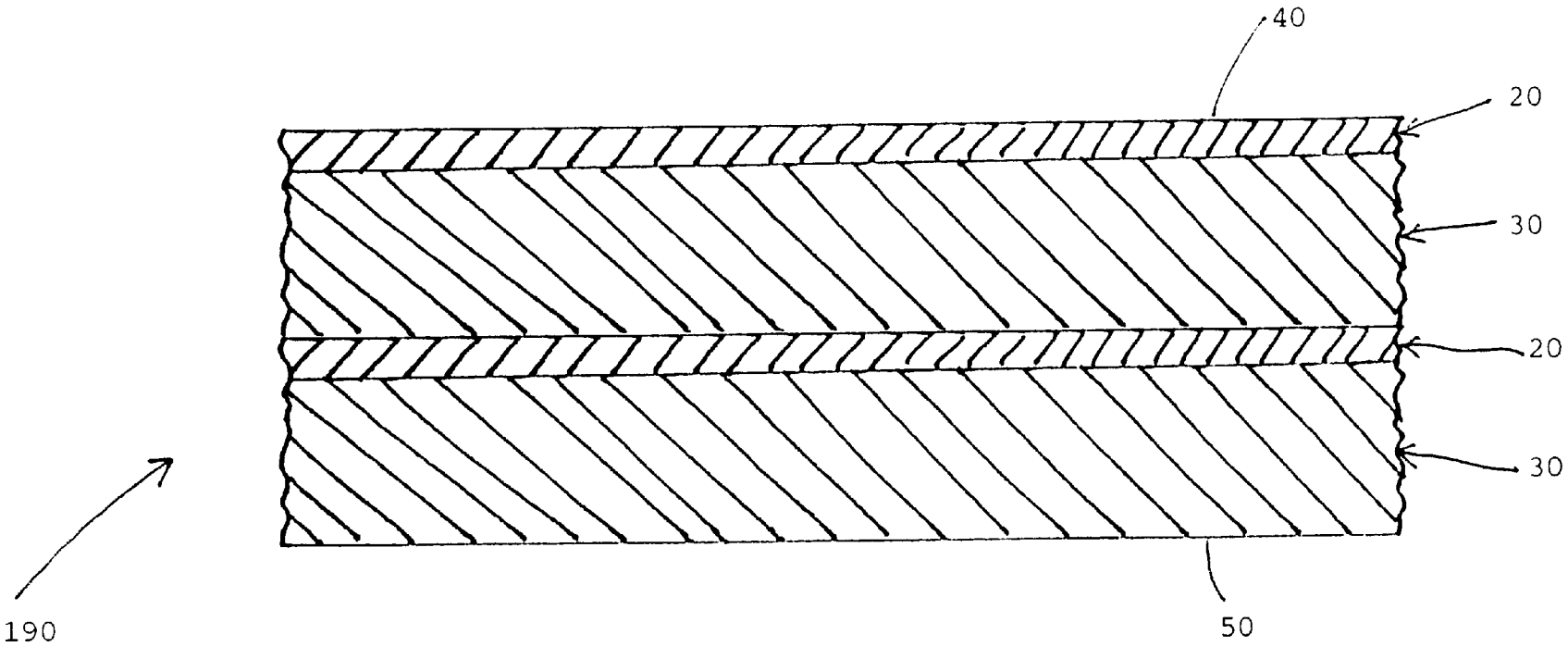
FIG. 7 is a side view, in section, of another alternative embodiment of the present invention.

By way of further example, FIG. 7 shows a flashing 190 having two sheet layers 20 and two foam layers 30, all attached together so as to form a single composite structure. In this situation, the flashing's outer surface 40 will be defined by the outer surface of the outermost sheet layer 20, and the flashing's inner surface 50 will be defined by the inner surface of the innermost foam layer 30.

Figure 8:
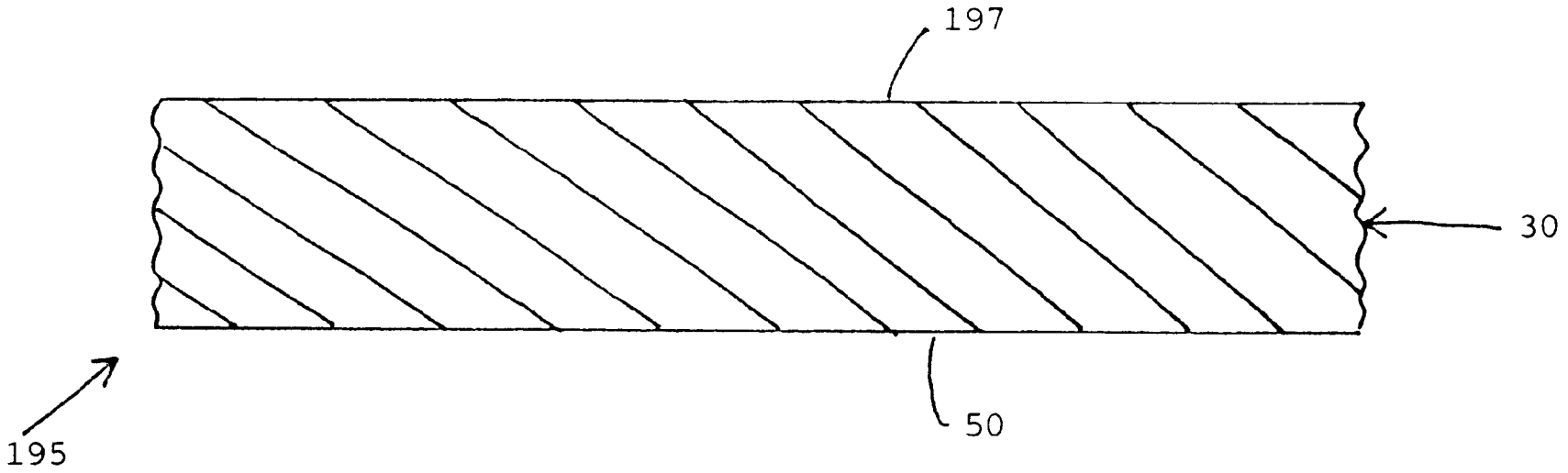
FIG. 8 is a side view, in section, of still another alternative embodiment of the present invention.

Furthermore, where foam layer 30 is formed out of a material which is waterproof in and of itself, and which possesses the required degree of structural integrity, sheet layer(s) 20 can be omitted entirely, in the manner shown in FIG. 8. In this case, the flashing 195 would have its outer surface defined by the foam layer's outer surface 197, and the flashing would have its inner surface defined by the foam layer's inner surface 50. By way of example, sheet layer(s) 20 can be omitted where foam layer 30 is formed out of a cross-linked or extruded polyethylene foam having a density of between about 0.5 $lb/ft^3$ and 9.0 $lbs/ft^3$; or where foam layer 30 is formed out of a cross-linked or extruded polypropylene foam having a density of between about 0.5 $lb/ft^3$ and 9.0 $lbs/ft^3$; or where foam layer 30 is formed out of an extruded polyvinychloride foam of between about 0.5 $lb/ft^3$ and 9.0 $lbs/ft^3$.

Figure 9:
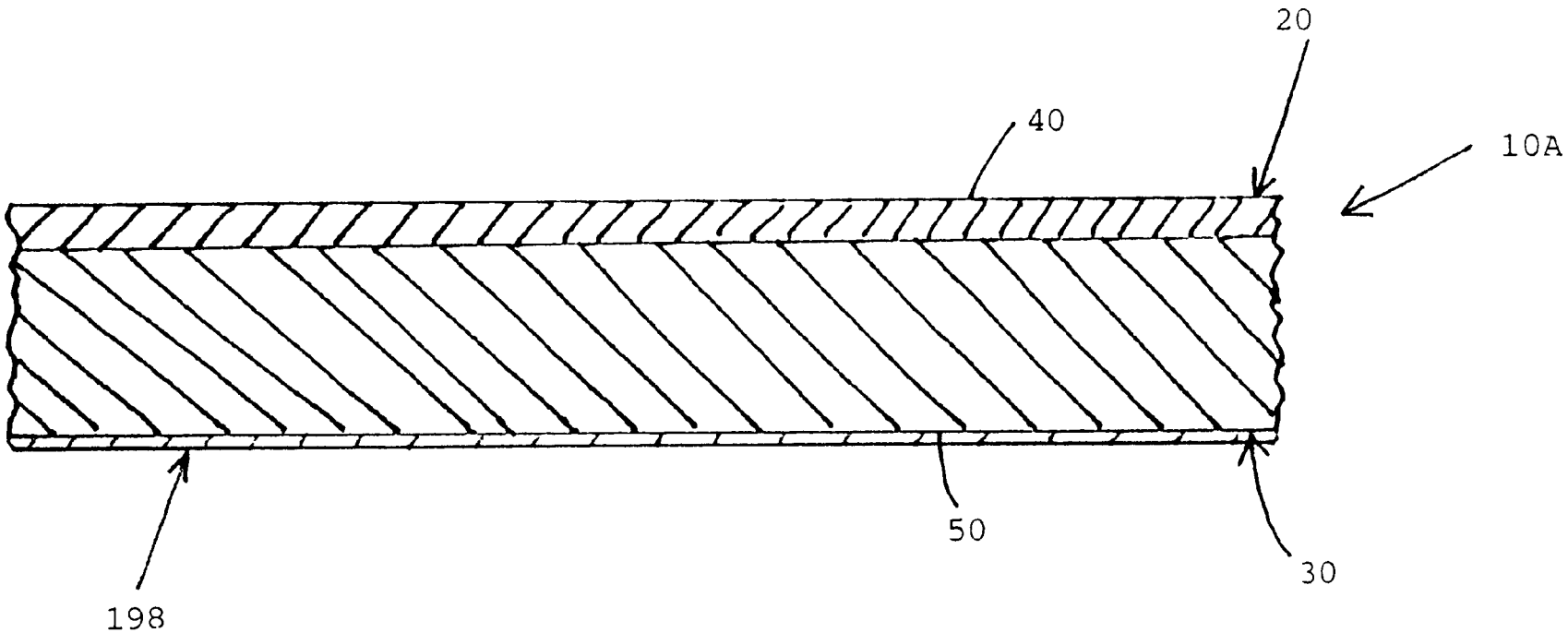
FIG. 9 is a side view, in section, of yet another alternative embodiment of the present invention.
Figure 10:
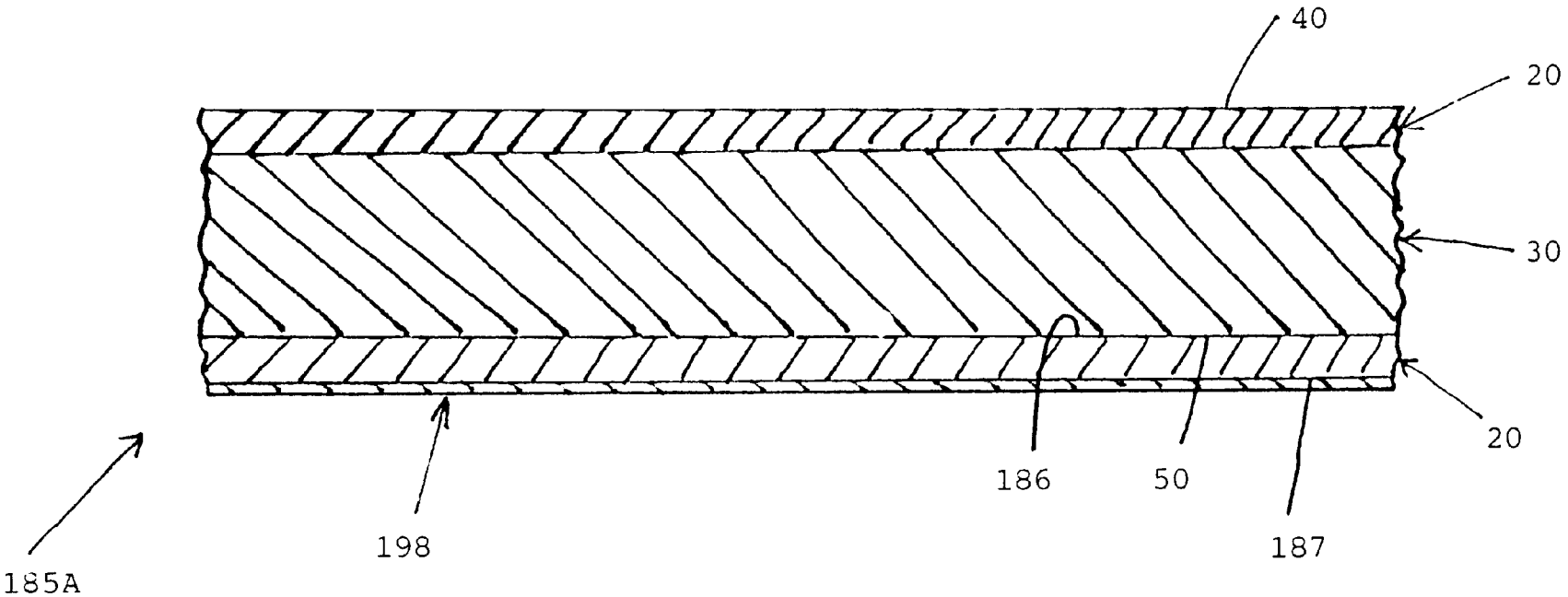
FIG. 10 is a side view, in section, of another alternative embodiment of the present invention.
Figure 11:
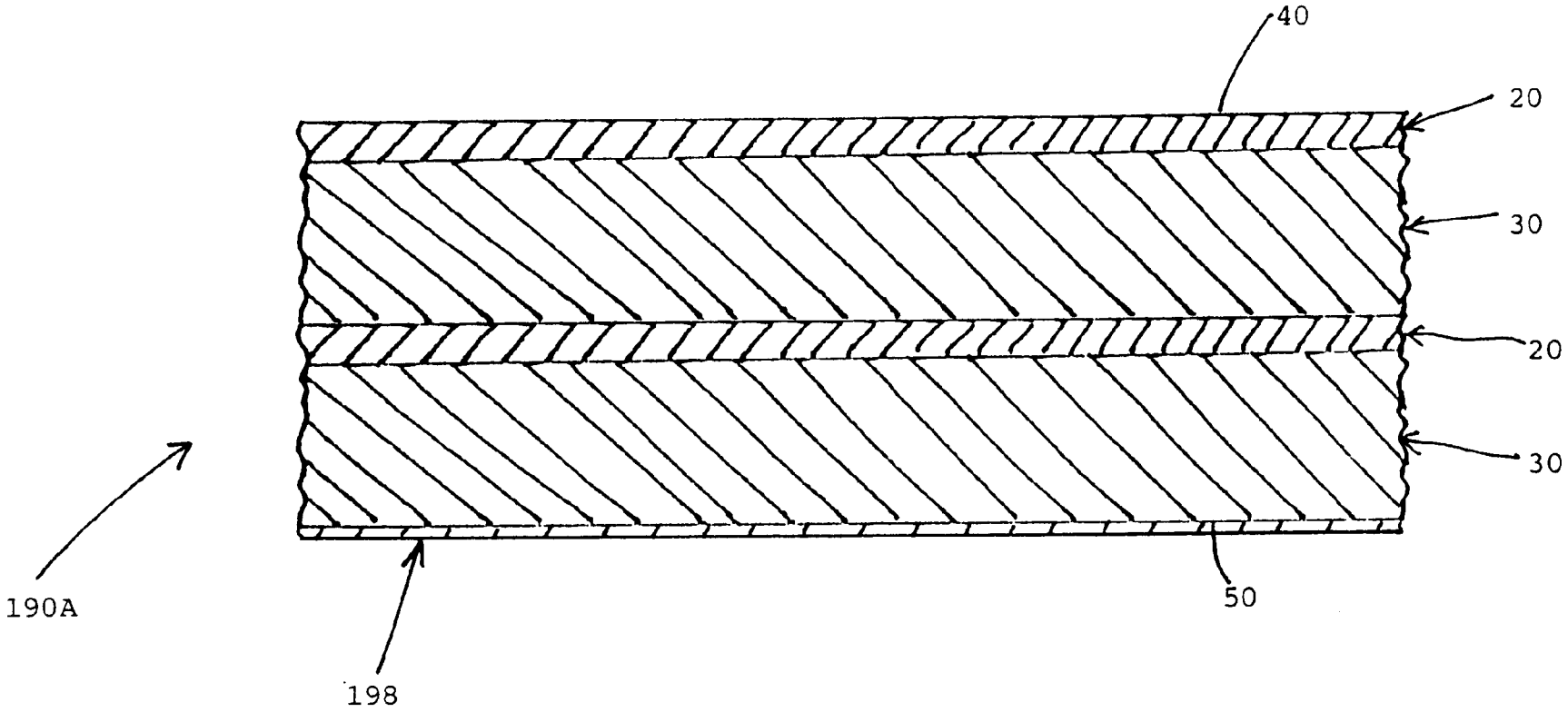
FIG. 11 is a side view, in section, of still another alternative embodiment of the present invention.
Figure 12:
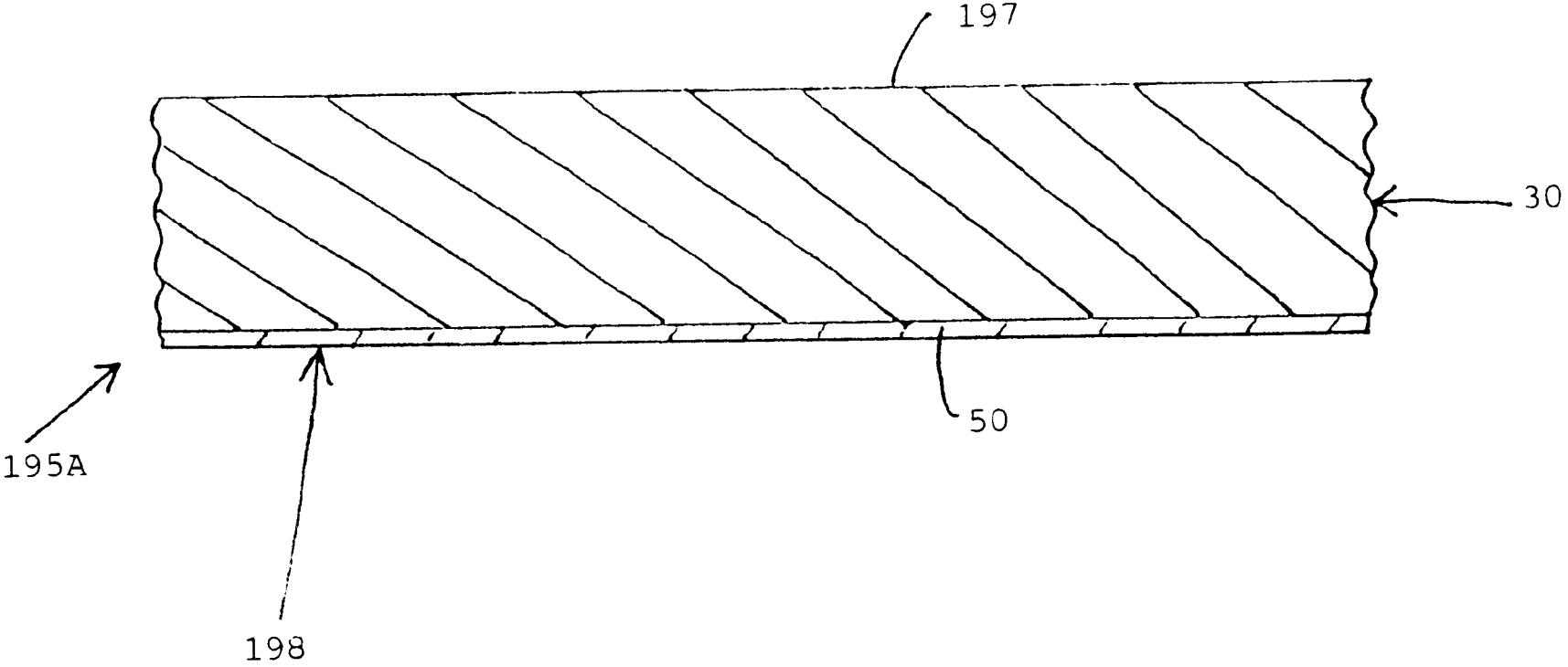
FIG. 12 is a side view, in section, of yet another alternative embodiment of the present invention.

Also, a pressure sensitive adhesive may be applied to the inner surface of the flashing so as to facilitate securing the flashing to a structure. In this case the need for a mastic or other separate attachment means may be eliminated. Such a pressure sensitive adhesive may be attached to the flashing's inner surface in ways well known in the art, e.g., by heat or pressure lamination. Thus, for example, FIG. 9 shows a flashing 10A which is identical to the flashing 10 of FIG. 1, except that the pressure sensitive adhesive 198 is applied to its inner surface 50; FIG. 10 shows a flashing 185A which is identical to the flashing 185 of FIG. 6, except that the pressure sensitive adhesive 198 is applied to its inner surface 187; FIG. 11 shows a flashing 190A which is identical to the flashing 190 of FIG. 7, except that the pressure sensitive adhesive 198 is applied to its inner surface 50; and FIG. 12 shows a flashing 195A which is identical to the flashing 195 of FIG. 8, except that the pressure sensitive adhesive 198 is applied to its inner surface 50.

Figure 13:
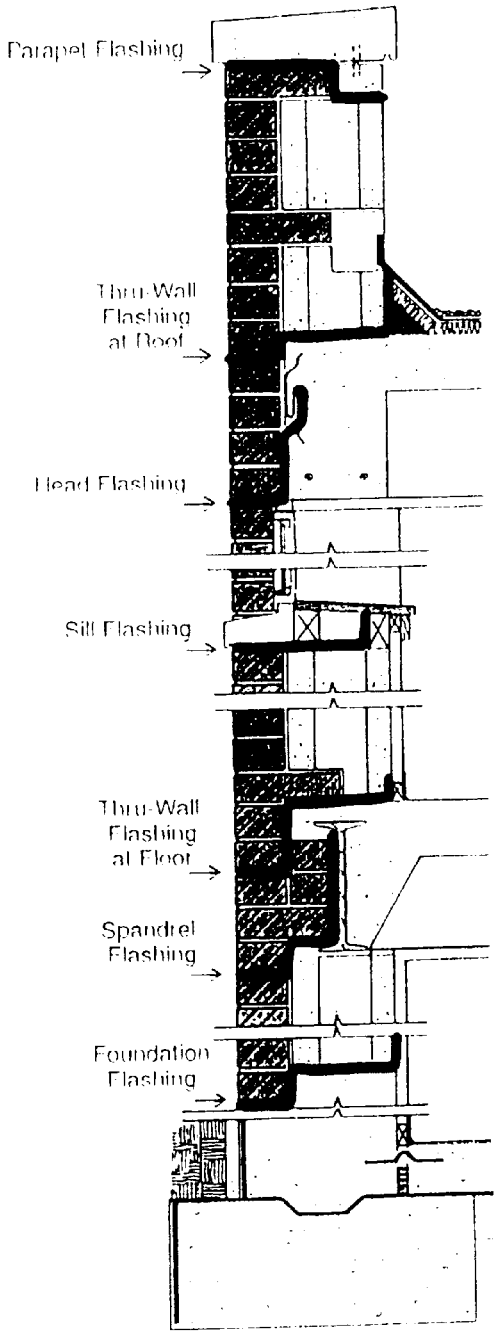
FIG. 13 is a schematic side view illustrating various possible applications for the flashing of the present invention.

It is also possible to use the flashing of the present invention in applications other than the exemplary construction application disclosed above in connection with FIGS. 3–5. By way of example, FIG. 13 illustrates just a few of the many possible uses of the flashing of the present invention in masonry structures.

Furthermore, it is also possible to use the flashing of the present invention in construction applications other than masonry structures, e.g., the flashing might be used in the construction of wooden structures, steel structures, etc.

Still other modifications of this sort will be obvious to a person skilled in the art.

It is to be understood that the present invention is by no means limited to the particular construction disclosed herein and/or shown in the drawings, but also comprises any modifications or equivalents within the scope of the claims.

Advantages Of The Invention

Numerous advantages are obtained through the use of the present invention.

For one thing, the present invention provides a new and improved form of flashing.

For another thing, the present invention provides a new and improved form of flashing which does not utilize a backing made out of asphalt or fabric or paper.

And the present invention provides a new and improved form of flashing which is fire-retardant.

Also, the present invention provides a new and improved form of flashing which provides a good thermal barrier.

Furthermore, the present invention provides a new and improved form of flashing which is self-sealing.

And the present invention provides a new and improved form of flashing which is relatively lightweight and is flexible under substantially all weather conditions.

In addition, the present invention also provides a new and improved form of flashing which is less susceptible to mildew and rotting problems.

Furthermore, the present invention also provides a new and improved form of flashing which provides a good acoustical barrier.

Also, the present invention provides an improved method for sealing joints and seams in masonry structures.

What is claimed is:

1. A flashing for rendering a seam in a structure watertight, said flashing comprising:

an inside surface for positioning against the seam in the structure and an outside surface for facing the environment, wherein said flashing comprises a composite comprising a sheet layer and a foam layer, said foam layer being disposed so as form said inside surface;

said sheet layer comprising a closed-surface, waterproof, non-elastic material which is lightweight and flexible; and said foam layer comprising a closed cell plastic foam material which is lightweight and flexible and a good thermal insulator, and which is resilient and water-resistant, whereby said foam layer can form a water-tight seal about any fastening device which may pierce the flashing during deployment of the flashing, and whereby said foam layer can fill out any surface imperfections it may lie against.

2. The flashing according to claim 1 wherein said sheet layer comprises a material which is rustproof, mildew-proof, rot-proof and fire-retardant.

3. The flashing according to claim 1 wherein said sheet layer is formed out of copper.

4. The flashing according to claim 1 wherein said sheet layer is formed out of aluminum.

5. The flashing according to claim 1 wherein said sheet layer is formed out of polyethylene plastic film.

6. The flashing according to claim 1 wherein said sheet layer is formed out of polypropylene plastic film.

7. The flashing according to claim 1 wherein said sheet layer is formed out of styrene plastic film.

8. The flashing according to claim 1 wherein said foam layer comprises first and second surfaces, and wherein said first surface of said foam layer is attached to said sheet layer and said second surface of said foam layer is diposed opposite thereto, and further wherein a pressure sensitive adhesive is positioned on the outside surface of said foam layer so as to facilitate attachment of said flashing to a structure during deployment of the flashing.

9. The flashing according to claim 1 wherein said foam layer is formed out of a cross-linked polyethylene foam.

10. The flashing according to claim 1 wherein said foam layer is formed out of an extruded polyethylene foam.

11. The flashing according to claim 1 wherein said foam layer is formed out of a cross-linked polypropylene foam.

12. The flashing according to claim 1 wherein said foam layer is formed out of an extruded polypropylene foam.

13. The flashing according to claim 1 wherein said foam layer is formed out of an extruded polyvinylchloride foam.

14. The flashing according to claim 1 wherein said foam layer comprises a material which is rustproof, mildew-proof, rot-proof and fire-retardant.

15. The flashing according to claim 1 wherein said composite comprises two sheet layers, wherein said foam layer is disposed between said two sheet layers.

16. The flashing according to claim 1 wherein said composite comprises two sheet layers and two foam layers, and wherein said sheet layers and said foam layers are all disposed in an alternating sequence.

17. A method of rendering a seam in a structure watertight, said method comprising the steps of:

(1) providing an article of flashing comprising:

an inside surface for positioning against the seam in the structure and an outside surface for facing the environment, wherein said flashing comprises a composite comprising a sheet layer and a foam layer, said foam layer being disposed so as form said inside surface;

said sheet layer comprising a closed-surface, waterproof, non-elastic material which is lightweight and flexible; and said foam layer comprising a closed cell plastic foam material which is lightweight and flexible and a good thermal insulator, and which is resilient and water-resistant, whereby said foam layer can form a watertight seal about any fastening device which may pierce the flashing during deployment of the flashing, and whereby said foam layer can fill out any surface imperfections it may lie against;

(2) placing said article of flashing over the seam in the structure which is to be made watertight, with said flashing being positioned so that said foam layer is oriented toward said seam and said sheet layer is oriented away from said seam; and (3) attaching said article of flashing to said structure.

18. A flashing for rendering a seam in a structure watertight, said flashing comprising an inside surface for positioning against the seam in the structure and an outside surface for facing said environment, wherein said flashing comprises a foam layer being disposed so as to form said inside surface, said foam layer comprising a closed cell plastic foam material which is lightweight and flexible and a good thermal insulator, and which is resilient and water-resistant, whereby said foam layer can form a watertight seal about any fastening device which may pierce the flashing during deployment of the flashing, and whereby said foam layer can fill out any surface imperfections it may lie against.

19. A method of rendering a seam in a structure watertight, said method comprising the steps of:

(1) providing an article of flashing comprising:

an inside surface for positioning against the seam in the structure and an outside surface for facing said environment, wherein said flashing comprises a foam layer being disposed so as to form said inside surface, said foam layer comprising a closed cell plastic foam material which is lightweight and flexible and a good thermal insulator, and which is resilient and water-resistant, whereby said foam layer can form a watertight seal about any fastening device which may pierce the flashing during deployment of the flashing, and whereby said foam layer can fill out any surface imperfections it may lie against;

(2) placing said article of flashing over the seam in the structure which is to be made watertight; and (3) attaching said article of flashing to said structure.

* * * * *